US009260665B2

(12) United States Patent
Zhu

(10) Patent No.: US 9,260,665 B2
(45) **Date of Patent: *Feb. 16, 2016**

(54) COAL DECOMPOSITION METHOD AND EQUIPMENT IN CYCLE HEATING GAS STYLE

(76) Inventor: Shucheng Zhu, Nanyang (CN)

( * ) Notice: Subject to any disclaimer, the term of this patent is extended or adjusted under 35 U.S.C. 154(b) by 246 days.

This patent is subject to a terminal disclaimer.

(21) Appl. No.: 13/578,631

(22) PCT Filed: Nov. 23, 2010

(86) PCT No.: PCT/CN2010/078981

§ 371 (c)(1),
(2), (4) Date: Aug. 13, 2012

(87) PCT Pub. No.: WO2012/055122

PCT Pub. Date: May 3, 2012

(65) Prior Publication Data

US 2012/0304537 A1 Dec. 6, 2012

(30) Foreign Application Priority Data

Oct. 26, 2010 (CN) ..... 2010 1 0527816

(51) Int. Cl.

| | |
|---|---|
| ***C10L 5/00*** | (2006.01) |
| ***C10B 49/04*** | (2006.01) |
| ***C10B 57/00*** | (2006.01) |
| ***C10B 47/00*** | (2006.01) |
| ***C10B 37/00*** | (2006.01) |
| ***C10B 53/04*** | (2006.01) |
| ***C10B 1/10*** | (2006.01) |

(52) U.S. Cl.

CPC . *C10B 49/04* (2013.01); *C10B 1/10* (2013.01); *C10B 37/00* (2013.01); *C10B 47/00* (2013.01); *C10B 53/04* (2013.01); *C10B 57/00* (2013.01)

(58) Field of Classification Search

CPC ..... C10B 1/10; C10B 49/04; C10B 53/04; C10B 57/00; C10B 47/00; C10B 37/00

USPC ..... 44/620, 629

See application file for complete search history.

(56) References Cited

U.S. PATENT DOCUMENTS 2,151,849 A * 3/1939 Hardy et al. ..... 202/131

FOREIGN PATENT DOCUMENTS

| | | | |
|---|---|---|---|
| CN | 101113340 A | | 1/2008 |
| CN | 101113340 A | * | 1/2008 |
| CN | 101693848 A | | 4/2010 |
| CN | 101693848 A | * | 4/2010 |

OTHER PUBLICATIONS

English Translation of CN 101113340 A.*
English Translation of CN 101693848 A.*
International Search Report of PCT/CN2010/078981.

* cited by examiner

*Primary Examiner* — James Goloboy
*Assistant Examiner* — Latosha Hines

(57) ABSTRACT

The invention discloses a coal decomposition method and equipment in cycle heating gas style. The coal decomposition equipment can avoid introducing impurity, ensure a pure decomposed gas and keep continuous heating without extrinsic heat source, which includes an airtight kiln body with coal inlet and coal outlet; a facility for impelling and decomposing coal set in the kiln body; a coal decomposed gas collecting pipe set in one end of the airtight kiln body, and a high temperature gas input pipe set in the other end of the airtight kiln body; wherein the coal decomposed gas collecting pipe is connected with a post-processing facility and communicates with the high temperature gas input pipe through a circle pipe, and the circle pipe and/or the high temperature gas input pipe comprises a heating device.

2 Claims, 2 Drawing Sheets

COAL DECOMPOSITION METHOD AND EQUIPMENT IN CYCLE HEATING GAS STYLE

FIELD OF THE INVENTION

The invention relates to comprehensive utilization of coal substance for saving energy and emission reduction, particularly to a cycle heating gas style decomposition method and equipment for coal.

BACKGROUND OF THE INVENTION

In convention technology, coal is used to produce coral gas, natural gas, or used to produce gas by coking at high temperature, medium temperature or low temperature. However, the above-mentioned process is required to block pulverized coal or sift lamp coal, as a result, it increases the cost of raw material, or cause the produced gas without a high heat value, a big additional value, and a significant economy and social benefits. The heating methods of furnace can be classified as external-heating style, internal heating style and hybrid-heating style. Specifically, the heating medium in external-heating furnace is not contact directly with raw materials and heat is conducted from furnace wall. The heating medium in the internal-heating furnace contacts with the raw materials directly, and the heating methods are classified as solid heat carrier style and gas heat carrier style according to different heat mediums. In order to attain more purified coal decomposed gas, the heating source part extends out of a channel for impelling and decomposing coal in a shape of flame gas pipe so as to get more purified coal decomposed gas. However, in practical production process, on the one hand, the manufacturing process for each close-packed heating pipe is very complicated and there would be some problem of leakage and cross-channeling in this kind of sealing model, which may cause a potential safety problem. In particularly, the problem of double rotation high temperature airtight between flame gas converged pipe of the flame gas heating pipe and coal decomposed gas collecting pipe also blocks a fast development of decomposition equipment. In addition, the combustion chamber which has problems easily is set inside of the kiln body, so it is not convenient for inspection, overhaul and timely mastering combustion dynamic thereof, and thus increasing the quantity of security blind spots.

SUMMARY OF THE INVENTION

To solve the above problems in prior arts, an object of the present invention is to provide a coal decomposition method and equipment in cycle heating gas style, which can avoid introducing impurity, ensure a pure decomposed gas and keep continuous heating without extrinsic heat source.

According to the present invention, a coal decomposition method in cycle heating gas style comprising the following steps:

(a) Making the coal sufficiently contact with decomposed gas or inert gas in high temperature in an airtight space to absorb heat and be heated up;

(b) Heating the coal up to a decomposing temperature so as to decompose the coal to high heating value coal and coal decomposed gas;

(c) Collecting and storing the produced high-value coal, and collecting, dedusting and separating the coal decomposed gas; and then pressure liquefying or purifying a part of the coal decomposed gas and making the detached inert gas or the other part of the coal decomposed gas into the airtight space react with the undecomposed coal after being heated;

(d) Introducing the undecomposed coal or newly-feeding coal into step (a) again and making the introduced coal sufficiently contact with the cycle-introduced coal decomposed gas or inert gas in high temperature to absorb heat and be heated up, so as to attain a circle of heating and decomposing coal with decomposed gas or inert gas.

According to the present invention, an equipment for coal decomposition in cycle heating gas style comprises: an airtight kiln body with coal inlet and coal outlet; a facility for impelling and decomposing coal set in the kiln body; a coal decomposed gas collecting pipe set in one end of the airtight kiln body, and a high temperature gas input pipe set in the other end of the airtight kiln body; wherein the coal decomposed gas collecting pipe is connected with a post-processing facility and communicates with the high temperature gas input pipe through a circle pipe, and the circle pipe and/or the high temperature gas input pipe comprises a heating device.

According to an embodiment of the invention, the heating device comprises a fuel supply pipe, an air supply pipe and a combustion heating chamber.

According to another embodiment of the invention, the fuel supply pipe communicates with the coal decomposed gas collecting pipe through the post-processing facility.

According to an embodiment of the invention, the heating device is an electrical heating device.

According to the present invention, since the decomposed gas is acted as heat transfer media, and make the coal decomposed gas produced in high temperature kiln body or inert gas enter the kiln body again through the heating pipe. The high temperature gas sufficiently contacts with the rolled pulverized coal so that the pulverized coal can adequately absorb heat and be heated up rapidly so as to be decomposed to more coal decomposed gas and high-value heat coal in the kiln body. A large proportion of the coal decomposed gas is collected, dedusted, separated and pressure liquefied. The high-value heat coal is output from the coal outlet, and a small amount of the coal decomposed gas or the separated inert gas enters the kiln body again after being heated to react with the undecomposed or newly-feeding coal. Thus, a circle of heating coal by the decomposed gas is finished. Most importantly, the decomposed gas is utilized as a media to contact and react with the coal so that no any new gas is introduced and thus ensure the purity of the decomposed gas fundamentally. In addition, using inert gas as heat transfer media can greatly improve the safety of production process, although a step of separating inert gas is added in the production process. The fuel in the fuel supply pipe used for heating the decomposed gas can also attained from a small part of the processed coal decomposed gas. Thus, the equipment of the invention can supply heat source by itself and is not necessary to add new heat source for the system. The coal decomposition method and equipment in cycle heating gas style of the present invention makes the decomposition and separation of the pulverized coal more fast and efficient so as to save and fully utilize energy and greatly increase the utilization rate and level of coal resources, thus it will produce a significant economic and social benefits for the entire society.

BRIEF DESCRIPTION OF THE DRAWINGS

The accompanying drawings facilitate an understanding of the various embodiments of this invention. In such drawings.

DETAILED DESCRIPTION OF THE INVENTION

A coal decomposition method in cycle heating gas style includes the following steps:

(a) Making the coal sufficiently contact with decomposed gas or inert gas in high temperature in an airtight space to absorb heat and be heated up;

(b) heating the coal up to a decomposition temperature so as to decompose the coal to high heating value coal and coal decomposed gas;

(c) Collecting and storing the produced high heating value coal, and collecting, dedusting and separating the coal decomposed gas; and then pressure liquefying or purifying a part of the coal decomposed gas and making the detached inert gas or the other part of the coal decomposed gas into the airtight space to react with the undecomposed coal after being heated;

(d) Introducing the undecomposed coal or newly-feeding coal into step (a) again and making the introduced coal sufficiently contact with the cycle-introduced coal decomposed gas or inert gas in high temperature to absorb heat and be heated up, so as to attain a circle of heating and decomposing coal with decomposed gas or inert gas.

Embodiment 1

Figure 1:
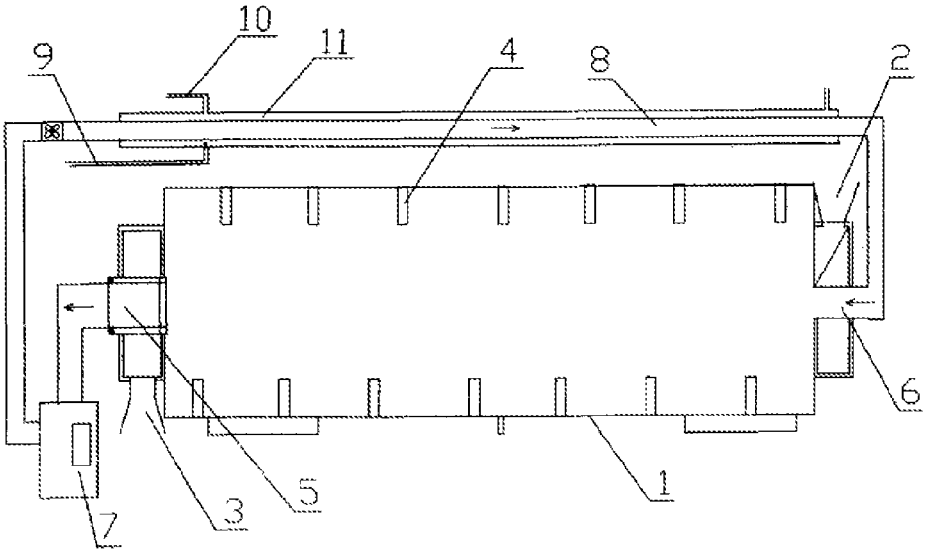
FIG. 1 is a schematic diagram of an equipment for coal decomposition in cycle heating gas style according to a first embodiment of the present invention.

Referring to FIG. 1, an equipment for coal decomposition in cycle heating gas style comprises an airtight kiln body 1 with a coal inlet 2 and a coal outlet 3. The kiln body 1 is a rotary kiln. A facility 4 for impelling and decomposing coal is set in the kiln body 1, which can be in a style of lifter, spiral or other transversely-impelling type. A coal decomposed gas collecting pipe 5 is set in one end of the airtight kiln body 1, and a high temperature gas input pipe 6 is set in the other end of the airtight kiln body 1. A post-processing facility 7 is connected with the coal decomposed gas collecting pipe 5, which can be a device for producing gas, or a device for dedusting, purifying, desulfurization, pressure liquefying. The coal decomposed gas collecting pipe 5 communicates with the high temperature gas input pipe 6 through a circle pipe 8. The circle pipe 8 and/or the high temperature gas input pipe 6 comprises a heating device, which includes a fuel supply pipe 9, an air supply pipe 10 and a combustion heating chamber 11. This kind of most reliable heating method and the large volume combustion heating chamber guarantee the efficiency of heat transfer. In the invention, other heating methods, such as electric heating, can also be applied. The input gas is the coal decomposed gas, and after the coal decomposed gas is processed in the post-processing facility 7, a large proportion of the coal decomposed gas is stored on an industrial scale and the rest portion of gas will exchange heat with the heating device again through a circle pipe fan, i.e., introducing the airtight kiln body to react with the undecomposed coal and thus a circle of decomposing coal by heating coal decomposed gas is achieved. In addition, the heat within the attained high temperature coal by coal decomposition can be used for preheating material.

Embodiment 2

Figure 2:
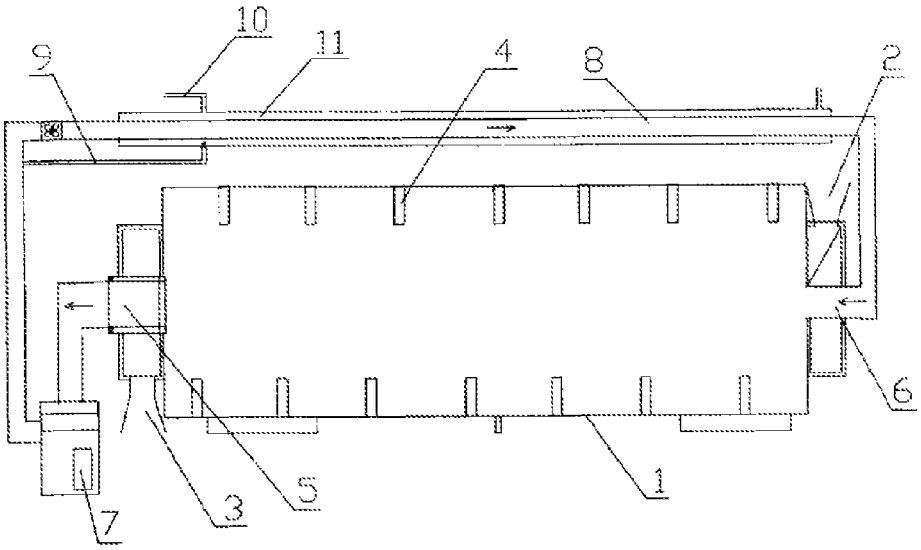
FIG. 2 is a schematic diagram of an equipment for coal decomposition in cycle heating gas style according to a second embodiment of the present invention.

Referring to FIG. 2, an equipment for coal decomposition in cycle heating gas style comprises an airtight kiln body 1 with coal inlet 2 and coal outlet 3. The kiln body 1 is a rotary kiln. A facility 4 for impelling and decomposing coal is set in the kiln body 1, which can be in a style of lifter, spiral or other transversely-impelling type. A coal decomposed gas collecting pipe 5 is set in one end of the airtight kiln body 1, and a high temperature gas input pipe 6 is set in the other end of the airtight kiln body 1. A post-processing facility 7 is connected with the coal decomposed gas collecting pipe 5, which can be a device for producing gas, or a device for dedusting, purifying, desulfurization, pressure liquefying. The coal decomposed gas collecting pipe 5 communicates with the high temperature gas input pipe 6 through a circle pipe 8. The circle pipe 8 and/or the high temperature gas input pipe 6 comprises a heating device, which includes a fuel supply pipe 9, an air supply pipe 10 and a combustion heating chamber 11. This kind of most reliable heating method and the large volume combustion heating chamber guarantee the efficiency of heat transfer. In the invention, other heating methods, such as electric heating, can also be applied. The input gas is the coal decomposed gas, and after the coal decomposed gas is processed in the post-processing facility 7, a large proportion of the coal decomposed gas is stored on an industrial scale and the rest portion of gas will exchange heat with the heating device again through a circle pipe fan, i.e., introducing the airtight kiln body to react with the undecomposed coal and thus a circle of heat decomposing coal by the coal decomposed gas is achieved. The fuel supply pipe 9 communicates with the coal decomposed gas collecting pipe 5 through the post-processing facility 7, so the fuel in the fuel supply pipe used for heating the decomposed gas can also attained from a small part of the processed coal decomposed gas. Thus, the equipment of the invention can supply heat source by itself and is not necessary to add new heat source for the system. In addition, the heat within the attained high temperature coal by coal decomposition can be used for preheating material.

Embodiment 3

Figure 3:
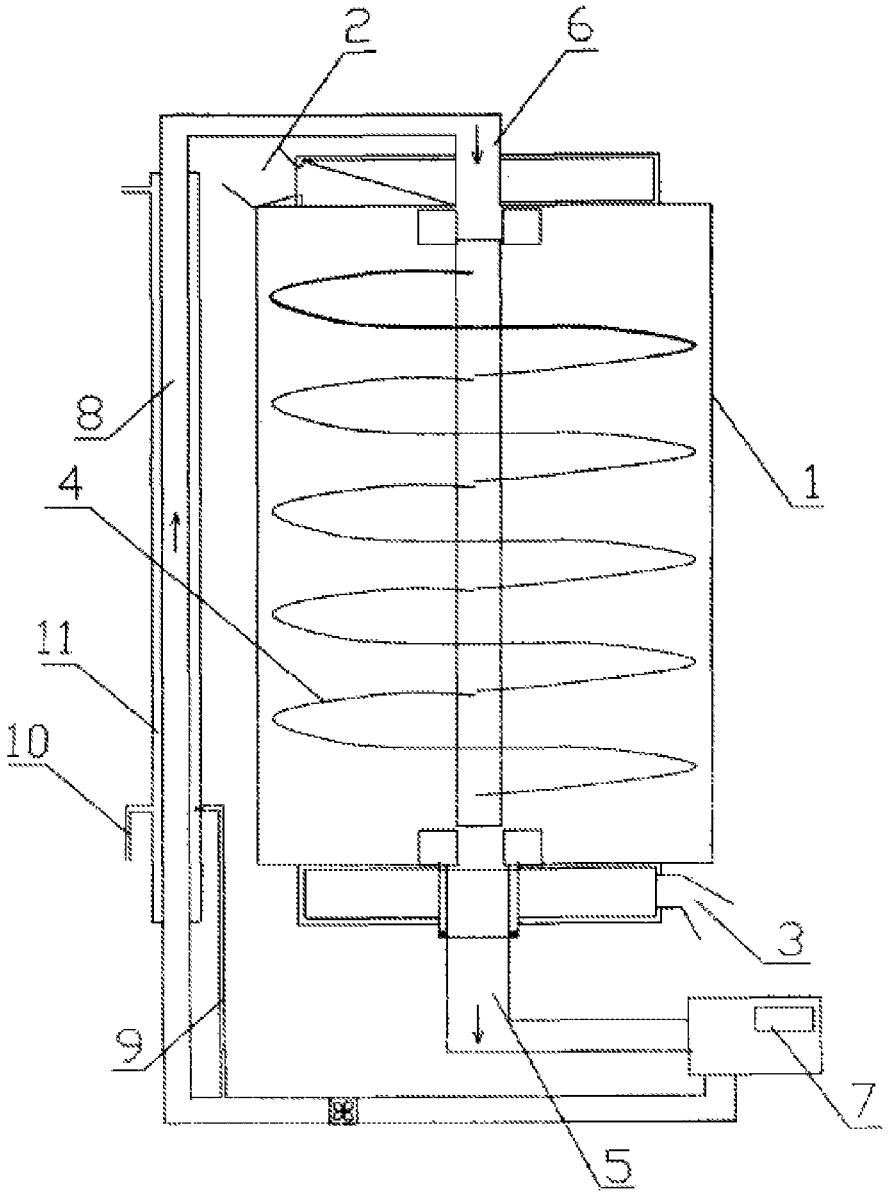
FIG. 3 is a schematic diagram of an equipment for coal decomposition in cycle heating gas style according to a third embodiment of the present invention.

Referring to FIG. 3, an equipment for coal decomposition in cycle heating gas style comprises an airtight kiln body 1 with coal inlet 2 and coal outlet 3. The kiln body 1 is an up-draft kiln. A facility 4 for impelling and decomposing coal is set in the kiln body 1, which can be in a style of a large vertical spiral, grid vibration board or other vertically-impelling type. A coal decomposed gas collecting pipe 5 is set in one end of the airtight kiln body 1, and a high temperature gas input pipe 6 is set in the other end of the airtight kiln body 1. A post-processing facility 7 is connected with the coal decomposed gas collecting pipe 5, which can be a device for producing gas, or a device for dedusting, purifying, desulfurization, pressure liquefying. The coal decomposed gas collecting pipe 5 communicates with the high temperature gas input pipe 6 through a circle pipe 8. The circle pipe 8 and/or the high temperature gas input pipe 6 comprises a heating device, which includes a fuel supply pipe 9, an air supply pipe 10 and a combustion heating chamber 11. This kind of most reliable heating method and the large volume combustion heating chamber guarantee the efficiency of heat transfer. In the invention, other heating methods, such as electric heating, can also be applied. The input gas is inert gas and the coal sufficiently contacts with the input gas in the airtight kiln to absorb heat and be heated up; the coal will be decomposed to high-value heat coal and coal decomposed gas when being heated up to a temperature in a range of 300-900° C. Then, the produced high-value heat coal is collected and stored, and the coal decomposed gas is collected, dedusted and separated. A part of the coal decomposed gas is pressure liquefied or purified. Then, the inert gas separated from the post-processing facility 7 is heated and then introduced into the airtight kiln to react with the undecomposed coal; the undecomposed or newly-feeding coal is processed according to step (a) again, i.e., sufficiently contacting with the cycle-introduced inert gas to absorb heat and be heat up, thus a circle of decomposing coal by the heating inert gas is achieved. After the coal decomposed gas is processed in the post-processing facility 7, a large proportion of the coal decomposed gas is stored on an industrial scale and the rest portion of gas will exchange heat with the heating device again through a circle pipe fan, i.e., introducing the airtight kiln body to react with the undecomposed coal and thus a circle of heat decomposing coal by the inert gas is achieved. The fuel supply pipe 9 communicates with the coal decomposed gas collecting pipe 5 through the post-processing facility 7, so the fuel in the fuel supply pipe used for heating the decomposed gas can also attained from a small part of the processed coal decomposed gas. Thus, the equipment of the invention can supply heat source by itself and is not necessary to add new heat source for the system. In addition, the heat within the attained high temperature coal by coal decomposition can be used for preheating material.

Embodiment 4

Referring to FIG. 3, an equipment for coal decomposition in cycle heating gas style comprises an airtight kiln body 1 with coal inlet 2 and coal outlet 3. The kiln body 1 is an up-draft kiln. A facility 4 for impelling and decomposing coal is set in the kiln body 1, which can be in a style of a large vertical spiral, grid vibration board or other vertically-impelling type. A coal decomposed gas collecting pipe 5 is set in one end of the airtight kiln body 1, and a high temperature gas input pipe 6 is set in the other end of the airtight kiln body 1. A post-processing facility 7 is connected with the coal decomposed gas collecting pipe 5, which can be a device for producing gas, or a device for dedusting, purifying, desulfurization, pressure liquefying. The coal decomposed gas collecting pipe 5 communicates with the high temperature gas input pipe 6 through a circle pipe 8. The circle pipe 8 and/or the high temperature gas input pipe 6 comprises a heating device, which includes a fuel supply pipe 9, an air supply pipe 10 and a combustion heating chamber 11. This kind of most reliable heating method and the large volume combustion heating chamber guarantee the efficiency of heat transfer. In the invention, other heating methods, such as electric heating, can also be applied. The input gas is the coal decomposed gas and the coal sufficiently contacts with the input gas in the airtight kiln to absorb heat and be heated up; the coal will be decomposed to high-value heat coal and coal decomposed gas when being heated up to a temperature in a range of 300-900° C. Then, the produced high-value heat coal is collected and stored, and the coal decomposed gas is collected, dedusted and separated. A part of the coal decomposed gas is pressure liquefied or purified. Then, the coal decomposed gas separated from the post-processing facility 7 is heated and then introduced into the airtight kiln to react with the undecomposed coal; the undecomposed or newly-feeding coal is processed according to step (a) again, i.e., sufficiently contacting with the cycle-introduced coal decomposed gas to absorb heat and be heat up, thus a circle of heat decomposing coal is achieved. After the coal decomposed gas is processed in the post-processing facility 7, a large proportion of the coal decomposed gas is stored on an industrial scale and the rest portion of gas will exchange heat with the heating device again through a circle pipe fan, i.e., entering the airtight kiln body to react with the undecomposed coal and thus a circle of heat decomposing coal by the coal decomposed gas or inert gas is achieved. The fuel supply pipe 9 communicates with the coal decomposed gas collecting pipe 5 through the post-processing facility 7, so the fuel in the fuel supply pipe used for heating the decomposed gas can also attained from a small part of the processed coal decomposed gas. Thus, the equipment of the invention can supply heat source by itself and is not necessary to add new heat source for the system. In addition, the heat within the attained high temperature coal by coal decomposition can be used for preheating material.

The above inert gas of the invention means that a gas media which is difficult to have a chemical reaction with oxygen or the coal decomposed gas. The gas media can be not only the inert gas in traditional sense, such as helium gas, argon gas, and but also carbon dioxide gas, anaerobic gas, and less oxygen gas.

What is claimed is:

1. A decomposition equipment for pulverized coal with circulating heating gas, comprising:

an airtight kiln body with coal inlet and coal outlet;

a facility for impelling and decomposing pulverized coal set in the kiln body, wherein the facility for impelling and decomposing pulverized coal is a lifter;

a coal decomposed gas collecting pipe set in one end of the airtight kiln body, and a high temperature gas input pipe set in the other end of the airtight kiln body; wherein the coal decomposed gas collecting pipe is connected with a post-processing facility and communicates with the high temperature gas input pipe through a circle pipe, a combustion heating chamber of a heating device surrounds the circle pipe to transfer heat to the processed coal decomposed gas processed by the post-processing facility in the circle pipe, such that the processed coal decomposed gas in the circle pipe and the combustion heating chamber of the heating device are not contacted, wherein the heating device comprises a fuel supply pipe, an air supply pipe and the combustion heating chamber.

2. The decomposition equipment for pulverized coal with circulating heating gas according to claim 1, wherein the heating device is an electrical heating device.

* * * * *